US009446268B2

(12) United States Patent
Williams

(10) Patent No.: US 9,446,268 B2
(45) **Date of Patent: *Sep. 20, 2016**

(54) EXTINGUISHING FLAMMABLE LIQUID FIRE IN AN INDUSTRIAL STORAGE TANK

(76) Inventor: Dwight P. Williams, Vidor, TX (US)

( * ) Notice: Subject to any disclaimer, the term of this patent is extended or adjusted under 35 U.S.C. 154(b) by 1479 days.

This patent is subject to a terminal disclaimer.

(21) Appl. No.: 11/659,934

(22) PCT Filed: Aug. 12, 2005

(86) PCT No.: PCT/US2005/028946

§ 371 (c)(1),
(2), (4) Date: Feb. 9, 2007

(87) PCT Pub. No.: WO2006/023434

PCT Pub. Date: Mar. 2, 2006

(65) Prior Publication Data

US 2007/0251706 A1 Nov. 1, 2007

Related U.S. Application Data

(63) Continuation-in-part of application No. PCT/US2004/026762, filed on Aug. 19, 2004.

(60) Provisional application No. 60/496,494, filed on Aug. 20, 2003, provisional application No. 60/538,021, filed on Jan. 21, 2004.

(51) Int. Cl.
*A62C 3/06* (2006.01)
*A62C 99/00* (2010.01)

(52) U.S. Cl.
CPC ..... *A62C 3/06* (2013.01); *A62C 99/0036* (2013.01); *A62C 99/0045* (2013.01)

(58) Field of Classification Search
USPC ..... 169/43–50, 66, 68
See application file for complete search history.

(56) References Cited

U.S. PATENT DOCUMENTS

| | | | | |
|---|---|---|---|---|
| 1,844,373 A | | 2/1932 | Urquhart | |
| 1,860,825 A | * | 5/1932 | Thiede | 169/68 |
| 1,917,694 A | * | 7/1933 | Boyd | 169/68 |
| 2,260,733 A | | 10/1941 | Anfenger | |
| 2,692,649 A | * | 10/1954 | McCreary | 169/57 |
| 2,706,527 A | * | 4/1955 | Geza et al. | 169/57 |
| 2,772,743 A | * | 12/1956 | Eggleston | 169/68 |
| 2,936,834 A | * | 5/1960 | Gomory | 169/44 |

(Continued)

FOREIGN PATENT DOCUMENTS

| | | |
|---|---|---|
| JP | 08-229156 | 9/1996 |
| JP | 2003-000747 | 1/2001 |

(Continued)

OTHER PUBLICATIONS

IPER issued in PCT/US04/26762, Jul. 3, 2007.

(Continued)

*Primary Examiner* — Ryan Reis
(74) *Attorney, Agent, or Firm* — Sue Z. Shaper

(57) ABSTRACT

A system and apparatus for extinguishing a fire of a difficult to extinguish fuel or flammable liquid in a storage tank fitted with at least a significant top roof portion, the system including timely discharge of dry powder into a significantly enclosed space or cavity defined between the fuel/liquid surface, or between any floater remaining thereon, and the fixed top roof portion, and apparatus to facilitate the system.

18 Claims, 7 Drawing Sheets

(56) References Cited

U.S. PATENT DOCUMENTS

| | | | | |
|---|---|---|---|---|
| 2,996,119 | A * | 8/1961 | Foden et al. | 169/44 |
| 3,687,329 | A * | 8/1972 | Baum | 220/216 |
| 3,876,010 | A * | 4/1975 | Blomquist et al. | 169/46 |
| 4,148,361 | A * | 4/1979 | Christensen | 169/66 |
| 4,838,356 | A | 6/1989 | Akatsu | |
| 5,275,243 | A | 1/1994 | Williams | |
| 5,464,065 | A * | 11/1995 | Kaylor | 169/44 |
| 5,548,933 | A | 8/1996 | Sharma | |
| 5,573,068 | A | 11/1996 | Sharma | |
| 5,829,533 | A * | 11/1998 | Williams | 169/46 |
| 5,913,366 | A * | 6/1999 | Williams et al. | 169/46 |
| 6,398,136 | B1 | 6/2002 | Smith | |
| 2004/0140106 | A1 | 7/2004 | De Anda-Uribe et al. | |

FOREIGN PATENT DOCUMENTS

| | | |
|---|---|---|
| JP | 2002-017883 | 1/2002 |
| WO | WO 98/03226 | 1/1998 |
| WO | WO/98/03226 | 1/1998 |

OTHER PUBLICATIONS

Isr issued in PCT/US04/26762, Mar. 8, 2006.

* cited by examiner

Manual Handline Units

Large Manual Firefighting Equipment

For the big fires... see our large capacity dry chemical and twin-agent (dry chemical/foam) units. Various configurations including floor, skid and trailer-mounted units... and NOW INTRODUCING the MAGNUM Rapid Intervention Vehicle.

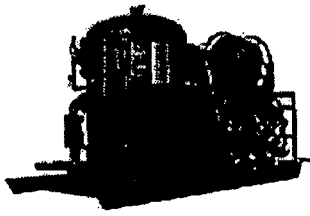

ANSUL® Large Dry Chemical Systems

Large dry chemical systems combine the flexibility of a hand portable extinguisher with the greater fire-killing power needed to combat large flammable liquid and gas fires.

DCS

Fig 8B

EXTINGUISHING FLAMMABLE LIQUID FIRE IN AN INDUSTRIAL STORAGE TANK

CROSS REFERENCE TO RELATED APPLICATIONS

This is a continuation-in-part of co-pending application PCT/US2004/026,762, filed Aug. 19, 2004, which in turn claims priority to provisional U.S. applications 60/496,494 filed Aug. 20, 2003 and 60/538,021, filed Jan. 21, 2004.

FIELD OF THE INVENTION

The instant invention relates to improved systems for extinguishing flammable liquid fire in an industrial scale storage tank having a roof creating a space above the liquid, typically a fixed roof on top of the tank, and in particular to methods and apparatus incorporating use of dry chemical.

BACKGROUND OF THE INVENTION

Industrial fuel and/or flammable liquid storage tanks frequently have a roof creating a space above the liquid, usually a fixed conically- or geodesically-shaped roof welded to the top of the tank. Such tanks may have a double roof, including an internal floating roof, called a floater, designed to float on top of the fuel/liquid with seals for sealing against the inside tank wall. The fixed cone or geodesic top roof is typically attached by welding. A roof system comprised of either a single fixed top portion or of two portions, a fixed top and a floater, creates and defines a space or cavity between either the surface of the fuel/liquid and/or the floater below and the top roof above.

Fire in an enclosed or fixed roof industrial storage tank can present unique problems. Industrial storage tanks are tanks with a diameter of a 60 feet or greater. Tank walls are typically 50 feet high, and usually 45 feet or higher. The top of the tank wall just below the rim is usually characterized by a series of eyebrow vents around its circumference. The eyebrow vents serve to allow vapor to escape from the tank rather than collect. Collecting of vapor within the tank presents numerous hazards. Thus, vents are typically provided to vent to the atmosphere vapors that collect in the space or cavity between the fuel/liquid (or floater) and a top fixed roof. The usual vents are "eyebrow vents" comprising spaced rectangular openings around a top portion of the vertical tank wall, scooper vents provided at the top of the tank and/or roof vents comprising spaced openings around the periphery of the top roof.

When vapor from the liquid within the tank, such as gasoline or crude, catches fire typically the roof is not blown off. The fire manifests itself predominantly at a downwind set of vents. (Air is sucked in through upwind vents.) The liquid within the tank is vaporizing, but the space above the liquid level and below the fixed roof typically offers insufficient oxygen to sustain a full burn. (The vapor mixture in the cavity may partially combust in the cavity.) The full ignition and complete combustion occurs, however, as the vapor exits the vents and comes into contact with the oxygen available in the atmosphere.

In the event of a fire in a fuel or flammable liquid tank having a fixed top roof, it is industry standard procedure, regulated by the NFPA, to extinguish the fire (or at least to attempt to do so) by a foam attack. The attack comprises laying a foam blanket on the fuel/liquid surface typically by discharging foam into the space or cavity between a fixed top roof and the liquid surface and/or a floater. As discussed above, full combustion typically occurs only at the vents where the fuel/liquid vapors meet atmospheric air, and typically only at the downwind vents while air is sucked into the cavity at the upwind vents.

NFPA has guidelines for the rate of foam application and the duration of a foam attack, adjusted for different type fuels or flammable liquids, different foams and different tanks, in order to achieve extinguishment.

It has been discovered that after laying down an adequate foam blanket, adequate by regulatory standards in the covered tank situation, the fire may persist. Observation indicates that significant vapor is yet trapped in the space above the foam blanket and below the fixed roof, and a certain amount of rich incomplete combustion may be taking place on top of the foam blanket within the enclosed space. Furthermore, since foam has a 25% drain time of 2-8 minutes, foam blankets are not permanent. Foam blankets, sooner or later, can permit vapors to pass through, replenishing the vapor supply within the space above the blanket. If the cavity above the liquid level and below the fixed roof is significant, the burn time for just the vapor trapped in the space, without any replenishment, could be long, several hours, which is unacceptably long even if an adequate foam blanket permits no further vapor to pass through. Foam supplies are limited, which dictates that the fire be extinguished within a given period of time.

An experience extinguishing a blended fuel tank fire in Guatemala demonstrated that foam alone may not extinguish a difficult fuel or flammable liquid fire in a storage tank having a fixed top roof, even when foam is placed in the cavity in accordance with NFPA recommended procedures, rates and durations. This appears disturbingly true of the new blended fuels having a high-octane content. It is a disconcerting discovery. Foam alone may not extinguish the fire at all, and quite likely will not do so per current NFPA regulations or guidelines. The instant inventor has further experience of vapor passing through a foam blanket and creating vapor foam bubbles. The bubbles drain out of vents and fall down to the ground burning.

It has been further determined that any flammable liquid, including crude, may produce vapors in a cavity above the surface of a liquid and below a roof that can keep a fire burning (at least at certain vents if not also, to an extent, within the cavity) for a significant time period after establishing a foam blanket. This fire may persist after the establishment of an NFPA adequate foam blanket. If the liquid level in the tank is low enough, and/or if the cavity is sufficiently large, fire from cavity vapor can persist for hours after the establishment of an adequate foam blanket. During this period foam dries out and vapors can traverse the foam blanket, replenishing the vapor in the cavity. Foam supplies may not be adequate to maintain a sufficient fresh foam blanket for hours.

The instant invention teaches, therefore, an improved system designed to cost effectively extinguish not only a "difficult fire" in a tank with a fixed roof, or a roof that creates a space between the roof and the liquid, but also a fire of any flammable liquid. The improved system is designed to cost effectively extinguish a fire of a difficult to extinguish fuel or flammable liquid having a high-octane content as well as a fire of any flammable liquid. The invention teaches a staged and timed discharge of dry chemical into the space between the burning fuel/liquid and the roof. The timing of the staging of the discharge of the dry chemical is selected to follow a pertinent period of foam application. Dry chemical is a limited and rationed resource. Discharging the dry chemical too soon might be ineffective and, thus, waste the resource.

The discharging of the dry chemical can be effected by one of several means or techniques, using portable and/or fixed systems. (A "fixed system" is equipment put in place prior to a fire, fixed prior to an emergency, in anticipation of emergencies. In contrast, portable systems are brought to the locale of the emergency upon notice.) Vents provided to vent vapors that collect under a roof can be advantageously used as an entry means to discharge the dry chemical into the space above the fuel/liquid and below the roof. Both portable and fixed systems could utilize existing vents. Alternately, special ports for fixed foam systems can be utilized for a fixed dry chemical system; as well, special ports for a fixed dry chemical system can be created.

It is the inventor's experience and observation that dry chemicals, timely inserted into a space between burning fuel/liquid and the roof, after a substantial foam attack, chase remaining persistent, pernicious fire or vagrant flames in the cavity and serve to completely extinguish the fire. The movement of air into the cavity through upwind vents or openings, as discussed above, aids a discharged suspended dry chemical in chasing the flames. Foam alone is an inferior and more costly means, if not an inadequate means, to completely extinguish residual flames in such a tank. Furthermore, foam is expensive. The extra time required to secure extinguishment by foam, even if it can be achieved with a continued application of foam alone as compared to the instant invention, is unnecessarily costly.

The instant staged dry chemical methodology and apparatus for extinguishing a "fixed roof" (so to speak) tank fire may be implemented in various forms, including using portable apparatus and/or fixed systems. Fixed systems and/or special portable apparatus could be less risky for firefighters, and as such would be preferred over a portable embodiment requiring firefighters to climb the tank, walk over the roof and insert dry chemical through an existing or created vent or opportune opening with a hand held nozzle.

The term "difficult to extinguish fuel or flammable liquid" or "difficult fuel or flammable liquid fires" is used herein to refer to fluid fuels or flammable liquids that are, at least, in substantial part, low-surface tension fuels/liquids and/or high-vapor pressure fuels/liquids and/or octane-boosted fuels/liquids and/or oxygenated fuels/liquids. The implied comparison in these instances would be recognized by one of skill in the art to be with the historic straight chain fuels or flammable liquids of the mid-20th century.

The instant invention, however, has been determined to also have significant application with the historic straight chain fuels or flammable liquids of the mid-twentieth century.

It should be understood that although a tank may be designed with, and originally exist with, a particular roof system, the initiation of a fire or hazard may have altered or destroyed part or all of the original roof system. Thus, the characterization of a storage tank may have to be reassessed. Original floating roofs, or floating roof portions, may have tilted or partially sunk or totally sunk. Seals may have been destroyed, in whole or in part. Fixed roofs may have been blown awry, or may have been partially dislodged or tilted, or at least their connections, such as a welded connection with a tank wall, may have been partially or totally destroyed. The instant invention relates to a tank that, at the time of the fire, still has at least a significant roof portion creating a substantially enclosed space above the fuel/liquid and below the roof. That is, the invention relates to situations where a difficult fuel or flammable liquid is on fire and there is at least a significant roof portion above the fuel/liquid surface, defining a substantially enclosed space or cavity there between. Although welds may be blown off from an original fixed roof portion, and hatches and vents may be blown apart, the invention applies if there remains a significant space or cavity between a burning fuel/liquid and a roof portion. Note again: the fuel/liquid may be burning only where it secures sufficient oxygen, such as where fuel vapors meet the atmosphere at vents or other open portions. Partial combustion may be taking place in the cavity.

SUMMARY OF THE INVENTION

The instant invention discloses a system for extinguishing a fire of a flammable liquid, including difficult to extinguish fuels, in a storage tank having at least a roof portion that creates a substantially enclosed space above a significant portion of the liquid and below the roof, usually a tank fitted with a fixed top roof that remains substantially in place. The invention includes creating a foam blanket on the fuel/liquid surface, such as by discharging foam into a cavity above the fuel/liquid. (A foam blanket should be understood to include foam and/or film.) Preferably after covering at least 90% of the liquid surface with a foam blanket and/or after establishing a foam blanket for a significant period of time under the circumstances, such that at least a minimal blanket of foam is created under the circumstances, most preferably after at least two-thirds of a NFPA recommended application rate/duration procedure guideline for the foam attack, then discharging dry chemical into a cavity above the foam blanket and below a roof portion. Preferably the dry chemical would be discharged during the last ten minutes of a NFPA recommended application rate/duration procedure guideline for a foam attack. Dry chemical would typically be discharged for a period of 10 to 30 seconds. Existing vapor vents offer fortuitous openings for discharging the dry chemical into the cavity between the fuel/liquid and the roof using portable or fixed dry chemical systems. Preferably a dry chemical fixed system could be already in place, having conduits and a nozzle ready to be connected to dry chemical sources, such as wheeled units or a dry chemical skid, and having a discharge orifice or nozzle in the cavity.

Preferable portable systems include a dry chemical wand, preferably attached to a T'ed or cellar-style discharge nozzle. The wand can be hung with the nozzle inserted through an opportune opening and/or vent. "Fish mouths," where the roof separates from the wall, provide opportune openings. The firefighter can then retreat a safe distance, avoiding the hazards to personnel occasioned from a flashback and/or roof explosion.

Fixed apparatus for extinguishing flammable liquid fire, including a difficult fuel, in a storage tank having a cavity between the fuel/liquid surface and a roof portion could include at least one dry chemical supply pipe or line rising along a portion of a tank wall and having at least one end opening into a tank vent or port, such as through a roof or eyebrow vent, or through a fixed foam system opening into a tank, or through a fixed dry chemical system port. The supply pipe could be placed in fluid communication with a wheeled unit, a skid, or the like, having a source of dry powder. The supply pipe is preferably permanently affixed, but could be portable. Preferably, a dry chemical discharge nozzle located in the cavity is in fluid communication with the supply pipe.

BRIEF DESCRIPTION OF THE DRAWINGS

A better understanding of the present invention can be obtained when the following detailed description of the preferred embodiments are considered in conjunction with the following drawings, in which:

FIG. 8B illustrates a commercially available large dry chemical source.

The drawings are primarily illustrative. It would be understood that structure may have been simplified and details omitted in order to convey certain aspects of the invention. Scale may be sacrificed to clarity.

DESCRIPTION OF THE PREFERRED EMBODIMENTS

Figure 1:
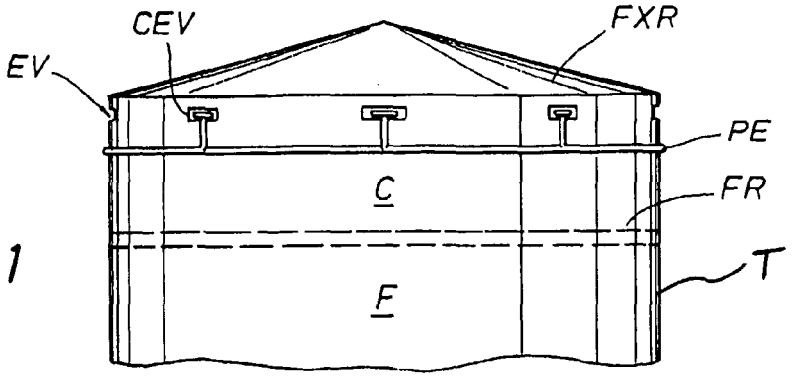
FIG. 1 illustrates a tank with a fixed top roof and a floater, creating a space or cavity in between. It should be understood that if a floater were not there, the space or cavity would be between the liquid surface and the fixed top.

FIG. 1 illustrates tank T having what is referred to as a composite roof system, the system comprised of a floating roof portion or floater FR and a fixed roof portion FXR. Space or cavity C is created between the floating roof portion FR and fixed roof portion FXR. Floating roof portion FR is understood to be floating on top of fuel/liquid F in tank T. It should be understood and appreciated that were there no floater, or were no floater to substantially remain at the time of a fire, the space or cavity C would be created above the fuel/liquid surface and below the fixed top roof portion.

In a worst-case scenario, fuel/liquid F is a blended fuel. Blended fuels can have a high-octane content that leads to difficult extinguishment situations. Fuel/liquid F is at least a flammable liquid and may be a difficult fuel/liquid to extinguish.

Figure 4:
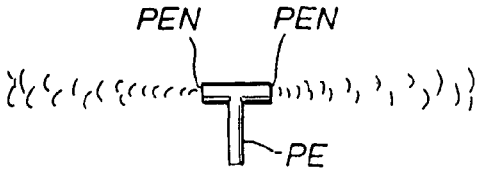
FIG. 4 illustrates an embodiment of a dry chemical discharge head for insertion inside a tank shell, preferably for insertion inside a vent.

Tank T in FIG. 1 also illustrates portions of a fixed or portable system for application of dry chemical, comprising a ring-shaped pipe extension PE having pipe extension legs with "T"ed ends PEN. FIG. 4 is a more detailed figure illustrating a pipe extension PE having "T"ed ends PEN. The "T"ed ends are structured to insert into eyebrow vents EV of tank T and to discharge therein a dry chemical, discharged inside of the tank shell into cavity C.

In a typical embodiment fixed roof portion FXR is a cone roof fixed to the top of the tank wall. Geodesic-shaped fixed top roofs are also known. Floating roof portion FR floats up and down with the surface of the fuel/liquid left in the tank T and has seals to seal against the inner tank wall. Of course, there may be no floating roof, or it may have sunk, totally or partially.

Figure 2:
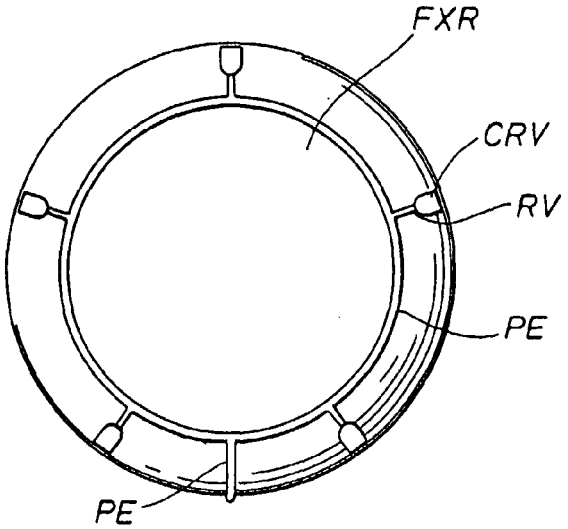
FIG. 2 illustrates a top view of a fixed top roof on a tank. The roof illustrates vents and portions of a dry chemical supply system.

FIG. 2 illustrates a top view of a cone roof FXR having a series of roof vents RV and roof vent covers CRV. FIG. 2 also illustrates portions of a fixed or portable system for application of dry chemical, including top extension TE extending up and onto cone roof FXR. In the embodiment of FIG. 2 pipe or line extension PE circles cone roof FXR proximate vents RV. A portion of pipe or line extension PE extends to vents RV such that the extension is capable of discharging dry chemical through the vent into cavity C in the tank.

Figure 3:
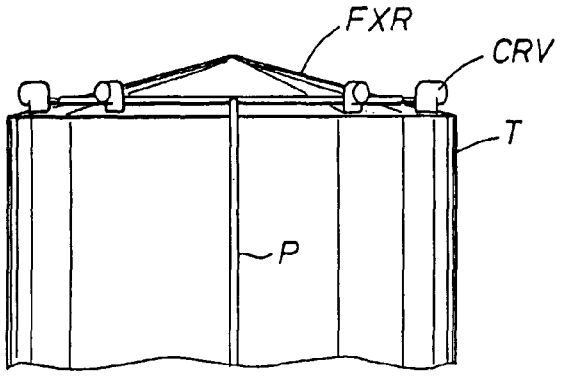
FIG. 3 illustrates a dry chemical riser pipe for a tank with a fixed roof.

FIG. 3 illustrates a portion of a dry chemical (fixed or portable) system including a riser pipe or supply pipe P. Preferably a tank comes equipped with a fixed riser pipe for application of dry chemical. However, a non-fixed portable dry chemical riser pipe P, or line, could be utilized. In a simple case, the pipe extension and pipe end might be no more than the end part of a straight riser pipe P. An end of such a straight dry chemical riser pipe could be inserted or wedged during a fire into an eyebrow vent.

In a situation where no fixed application system for dry chemical exists, offering preinstalled elements such as riser pipes, or pipe extensions, pipe ends and/or nozzles, the methodology can be carried out by firefighters using portable nozzles attached to supply lines. In such cases, however, a firefighter would have to approach (or to create) appropriate vents or openings on the tank or on the roof, proximate a cavity, in order to insert a dry chemical nozzle through the vent or opening.

When portable systems are used it is definitely preferable for the firefighter to hang a dry chemical nozzle on the end of a wand through an opportune opening, as opposed to manually holding a hand held dry chemical nozzle. There is a distinct possibility that the vapor could yet flash back and blow the roof off of the tank.

The methodology for extinguishing a flammable liquid fire in a tank with a fixed roof portion, including a difficult fire, includes an initial foam attack wherein a foam blanket is created. (Again, foam includes film.) Preferably foam is inserted into a cavity between a floating bottom roof portion and/or the fuel/liquid surface and a top roof portion to establish and create a foam blanket. Foam should be inserted or placed in the cavity until the fuel/liquid surface is substantially covered and the fire is substantially abated. Substantial abatement of the fire can be determined to have occurred in most cases when a foam blanket has been laid upon the surface of the fuel/liquid and/or floating roof in accordance with present NFPA guidelines for the foam, fuel/liquid and tank. The period of time this takes varies depending upon the type of foam used, the capacity for discharging foam, the size and complexity of the tank and the nature of the fuel/liquid it contains. Forty-five minutes represents a typical regulatorily approved time period for launching and sustaining a foam attack in a cavity between a floating roof and a top roof. In a preferred embodiment, sometime during the last ten minutes of any such foam attack, dry chemical would be inserted through one or more vents, or other available tank openings, into the cavity. If safer or more remotely activatable means are not available, the dry chemical attack can be implemented by a firefighter carrying a hand held nozzle, attached to a line and source of dry chemical, up to a suitable opening into the cavity. Preferably the fire fighter would hang a wand and dry chemical nozzle through a vent, fish mouth or opening of opportunity and then retreat to a safer distance. A ten second application of dry chemical offers a reasonable expectation for extinguishing the remnants of the fire, the vagrant remaining flames associated with the flammable liquid fire, especially those associated with the new blended fuels. It is the experience of the instant inventor that dry chemical timely inserted into such cavities in the above situation, augmented by the drafting air in the cavity, appears to "chase" the remaining fire within the cavity and to extinguish it. Without such dry chemical treatment, maintenance of a foam blanket may have to be extended for two or three times the present regulatorily set time periods, incurring considerable unanticipated expense. Indeed, there is no guarantee or experience conclusively showing that foam alone can extinguish a fire of a difficult flammable liquid in a tank under a fixed roof. Foam reserves may be inadequate to maintain the requisite foam blanket for the period of time required for the vapor in the cavity to cease combustion.

It is recommended in addition to cool tank wall portions above the liquid level and the roof, such as with a water fog, prior to application of the dry chemical. It is believed that dry chemical extinguishes fire primarily by interrupting a chain of oxygenation events. (Dry chemical also produces some amount of $C0_2$ that inhibits the fire.) The reignition of the fire in the vapors requires a threshold level of heat and oxygen. The foam blanket has removed heat from the liquid as well as the tank walls. Cooling the tank walls and roof removes additional heat. Access to oxygen is limited in the cavity to the available openings, primarily or typically the eyebrow vents. (Of course, other openings may have been created by the fire, such as blown hatches and/or destroyed seals.) The judicious timed application of dry powder can extinguish the fire with no reignition, given appropriate cooling efforts and augmented by limited access to oxygen.

Dry chemical is a relatively scarce commodity at a fire. The usage of dry chemical is carefully marshaled. Limitations on the supply of dry chemical make discharging dry chemical, even for a period of minutes, essentially unfeasible or impossible. Hence, dry chemical, if it is to be utilized, must be utilized judiciously. As a resource, compared to water and/or foam, in almost all circumstances its availability for use must be considered to be quite limited. Thus, a dry chemical attack is not preferred to be commenced until at least after two-thirds of the time period for a standard recommended NFPA foam attack as per NFPA guidelines. For example, if the foam attack should last over 55 to 60 minutes, the dry chemical attack preferably should not be begun until sometime in approximately the last 20 minutes, preferably not until sometime in the last 10 minutes. If there is no NFPA recommended application rate/duration procedure guideline for a particular foam or tank or fire in a given circumstance, the firefighter should extrapolate a reasonable guideline for the situation based on existing NFPA recommendations in the closest related circumstances, and take that as the NFPA guideline for this case.

Figure 5A:
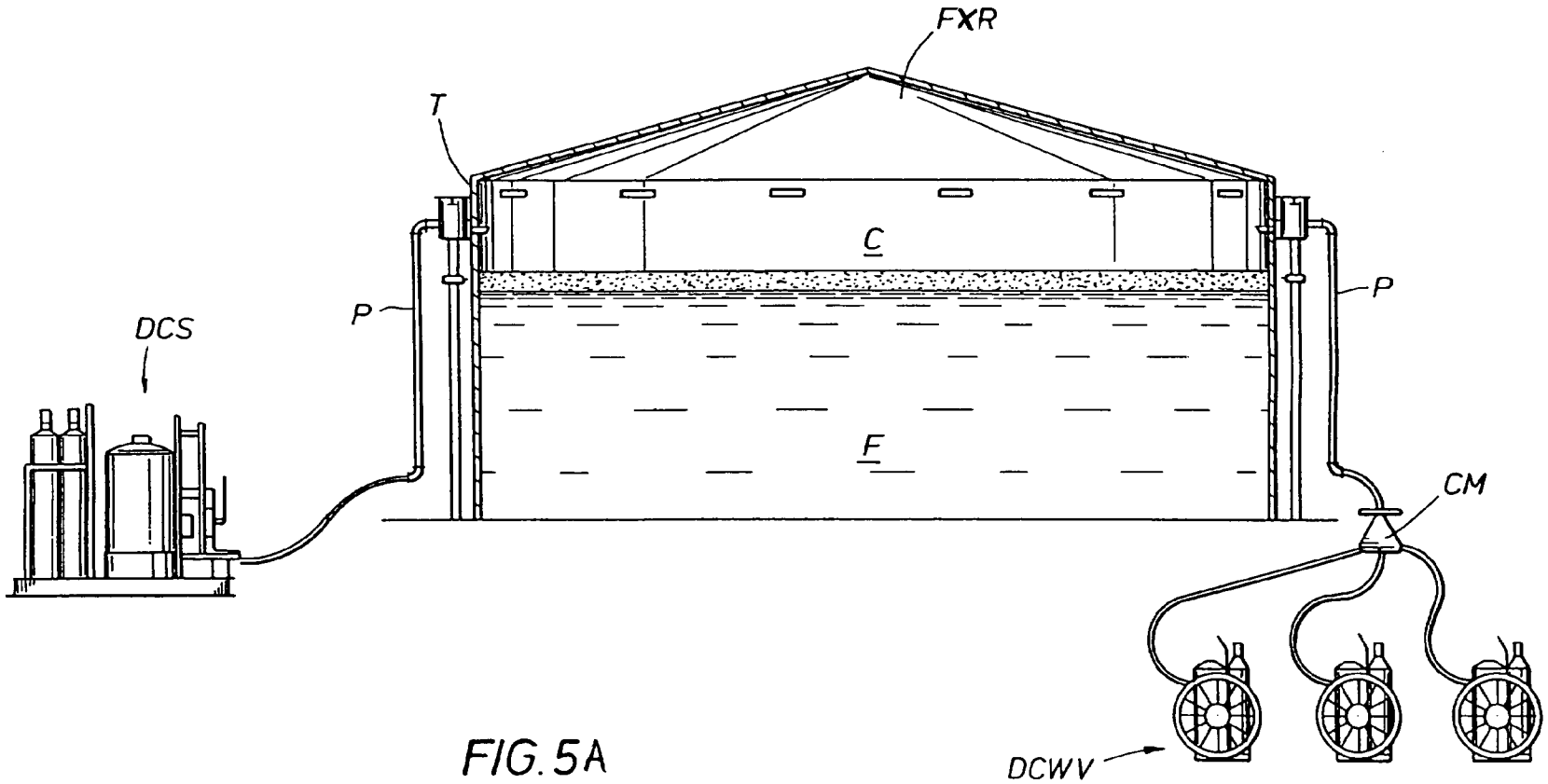
FIGS. 5A and 5B illustrate a tank with a fixed roof, the tank illustrated as having an integrated fixed foam/dry chemical system and a fixed dry chemical system, respectively.

FIG. 5A illustrates a tank T having a fixed roof FXR and a preferred embodiment for an integrated fixed system for use in applying foam and dry chemical. The preferred integrated fixed system for use in applying foam and dry chemical includes a foam expansion chamber FC-HC and related conduits and valving attached to a tank, the apparatus modified to provide dry chemical capabilities. Chamber FC-HC is shown attached at an upper level of a wall portion of tank T and communicating with the inside of the tank through opening O. Foam chamber FC-HC is shown in this embodiment having its own opening O or port into the inside of tank T and cavity C. Fixed pipe P communicates dry chemical between a typically mobile or portable dry chemical supply system, which could comprise, for instance, dry chemical wheeled units DCWV or a typical dry chemical skid DCS brought to the emergency. Dry chemical wheeled units would typically feed into a dry chemical collection manifold CM and then through a line to fixed pipe P. Fixed pipe P channels the dry chemical through foam expansion chamber FC-HC and through opening O to a discharge orifice or nozzle inside the tank. Associating fixed pipe P with the foam chamber allows both fixed systems to work out of one tank aperture or port.

Figure 5B:
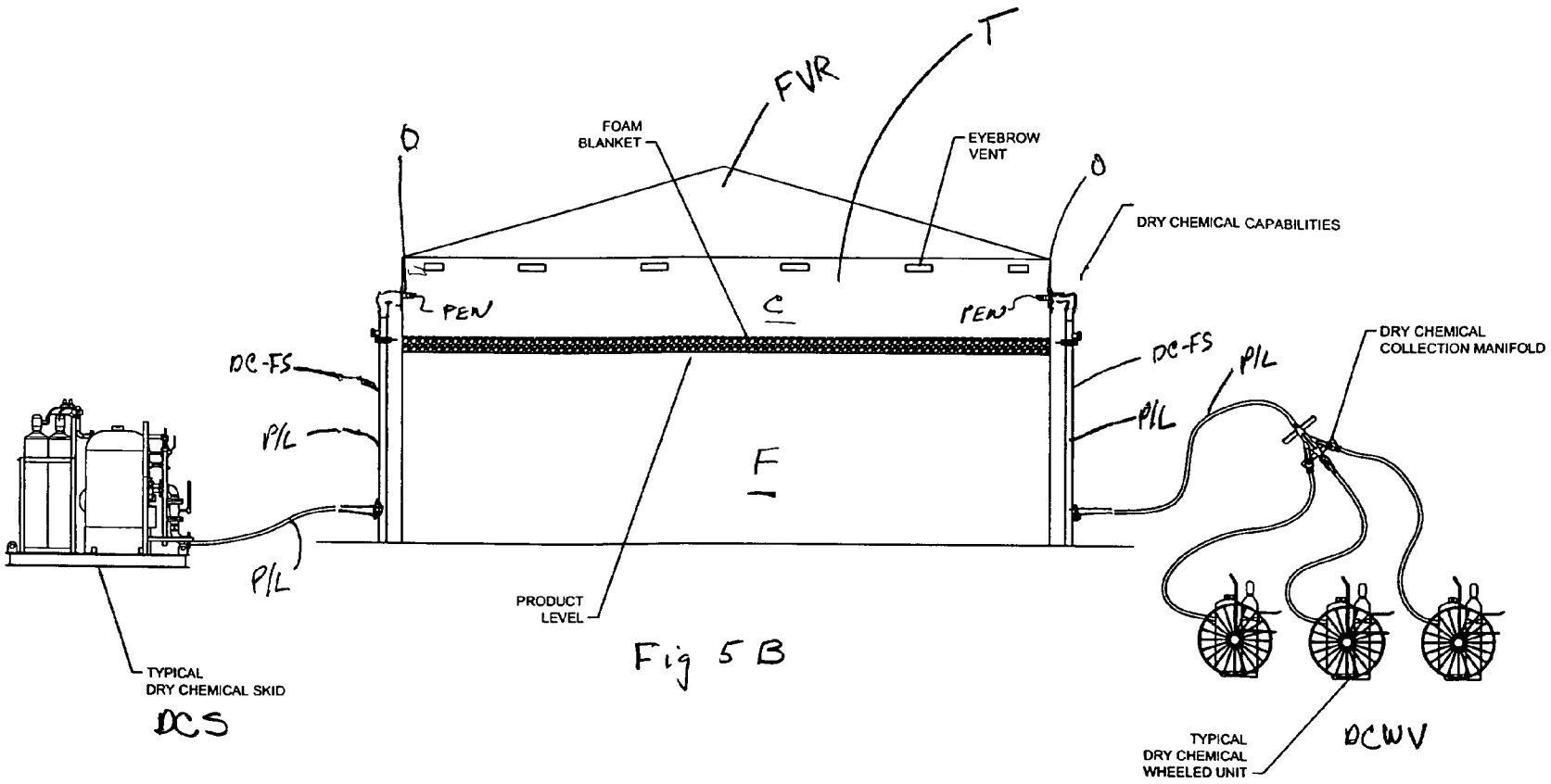

FIG. 5B illustrates a tank T having a fixed roof FXR and a preferred embodiment for a stand alone fixed system for applying dry chemical. The preferred stand alone fixed system for use in applying dry chemical includes pipe and/or line PL leading from sources of dry chemical, such as a typical dry chemical wheeled unit DCWV or a typical dry chemical skid DCS. The pipe and/or line combination, part of which is fixed to the tank, leads up to a port O in the upper tank wall. Preferably a dry chemical nozzle PEN is installed on the inside of the tank wall, fitted into port O and in fluid communication with pipe and/or line system PL.

Figure 6:
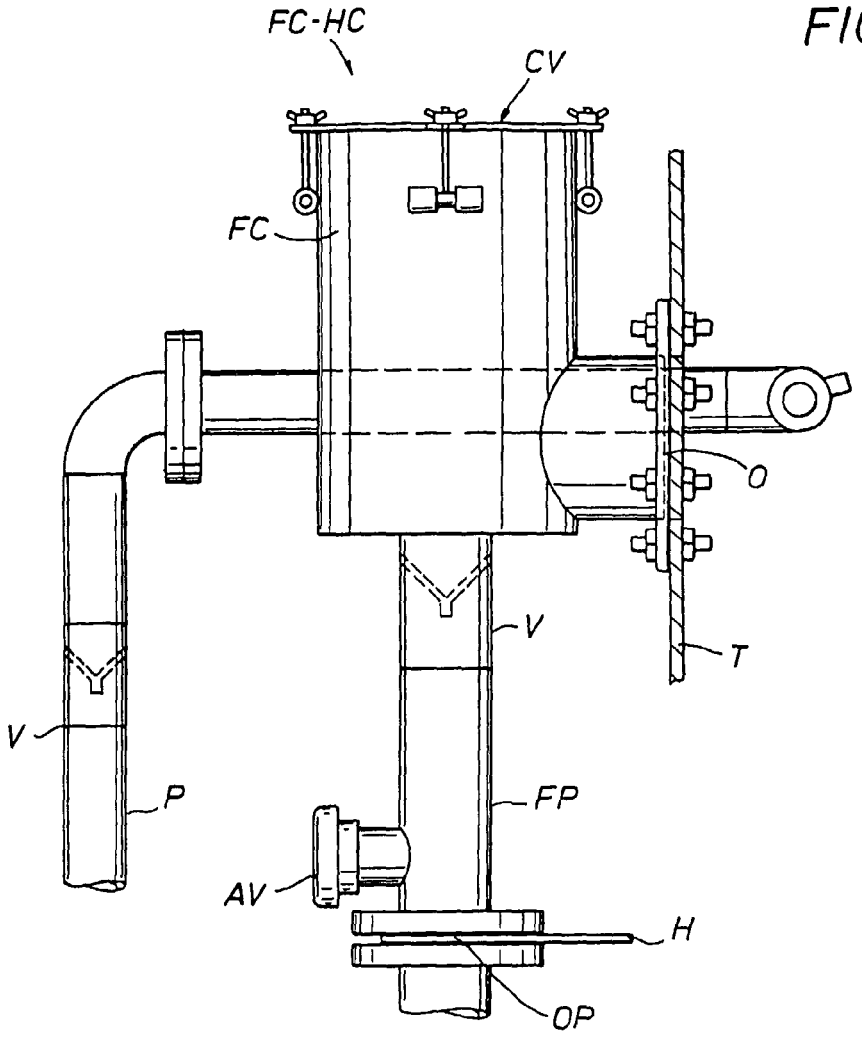
FIGS. 6 and 7 illustrate details of the integrated fixed foam and dry chemical system of FIG. 5A.
Figure 7:
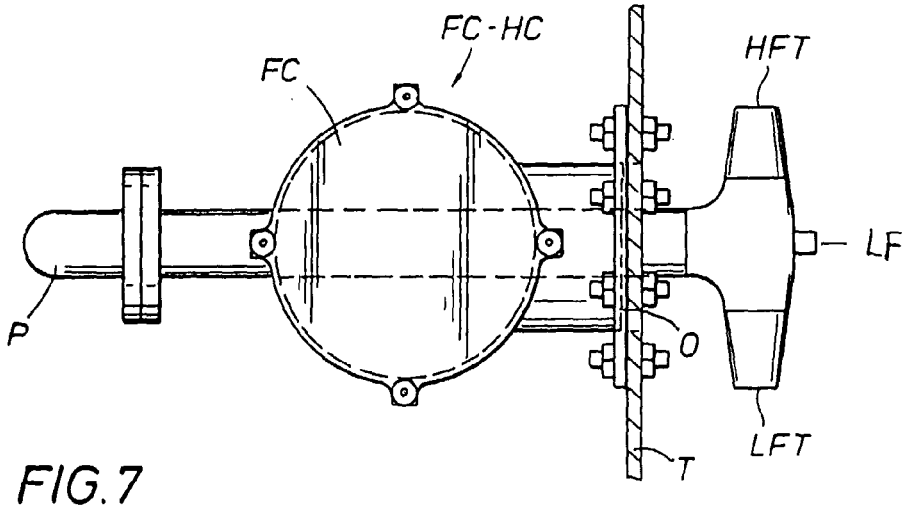

FIGS. 6 and 7 offer a side view and a plan view of foam expansion chamber FC-HC with dry chemical capabilities, as well as related conduits and valving. The foam expansion chamber provides a chamber for expansion and loss of velocity of the foam concentrate, prior to being discharged through opening O in sidewall of tank T. The foam system is fed fire extinguishing fluid comprising liquid water and foam concentrate through fluid pipe FP. The water and foam concentrate liquid passes through orifice plate OP having a small hole or orifice, creating a pressure differential there through. Orifice plate OP has a handle H and resembles a paddle. Pressure differential created over the orifice plate in line FP serves to draw in air through air vent AV shown as a mushroom vent with a screen. In the instant embodiment a check valve V is presented in the line as a vapor seal. Sufficient pressure from the water, foam concentrate and air will break the vapor seal sending the fluid into foam chamber FC. In foam chamber FC the foam will further expand and lose velocity prior to being discharged through opening O into the inside of tank T. Foam chamber FC is shown with an inspection cover or hatch CV, particularly important for inspection of the vapor seals.

In regard to the associated fixed system for the application of dry chemical, a chemical is fed from a source through pipe P, through its own check valve, vapor seal V, and then extending through opening O to a dry chemical discharge tip. The vapor seals or check valves may be of different designs and locations. FIGS. 6 and 7 also illustrate a high flow discharge tip HFT and a low flow discharge tip LFT. The discharge tip provides for discharging dry chemical preferably in three directions, to the left, to the right and adjustably toward the center. The tip might discharge in just one direction, preferably then adjustably toward the center. The discharge tip is preferably adjustable upon installation for anticipated preferred flow rates and directions, given the tank size. For instance, the discharge tip might be adjusted to discharge approximately 70 pounds per second total, 30 pounds per second to the left, 30 pounds per second to the right and 10 pounds per second toward a central area.

Figure 8A:
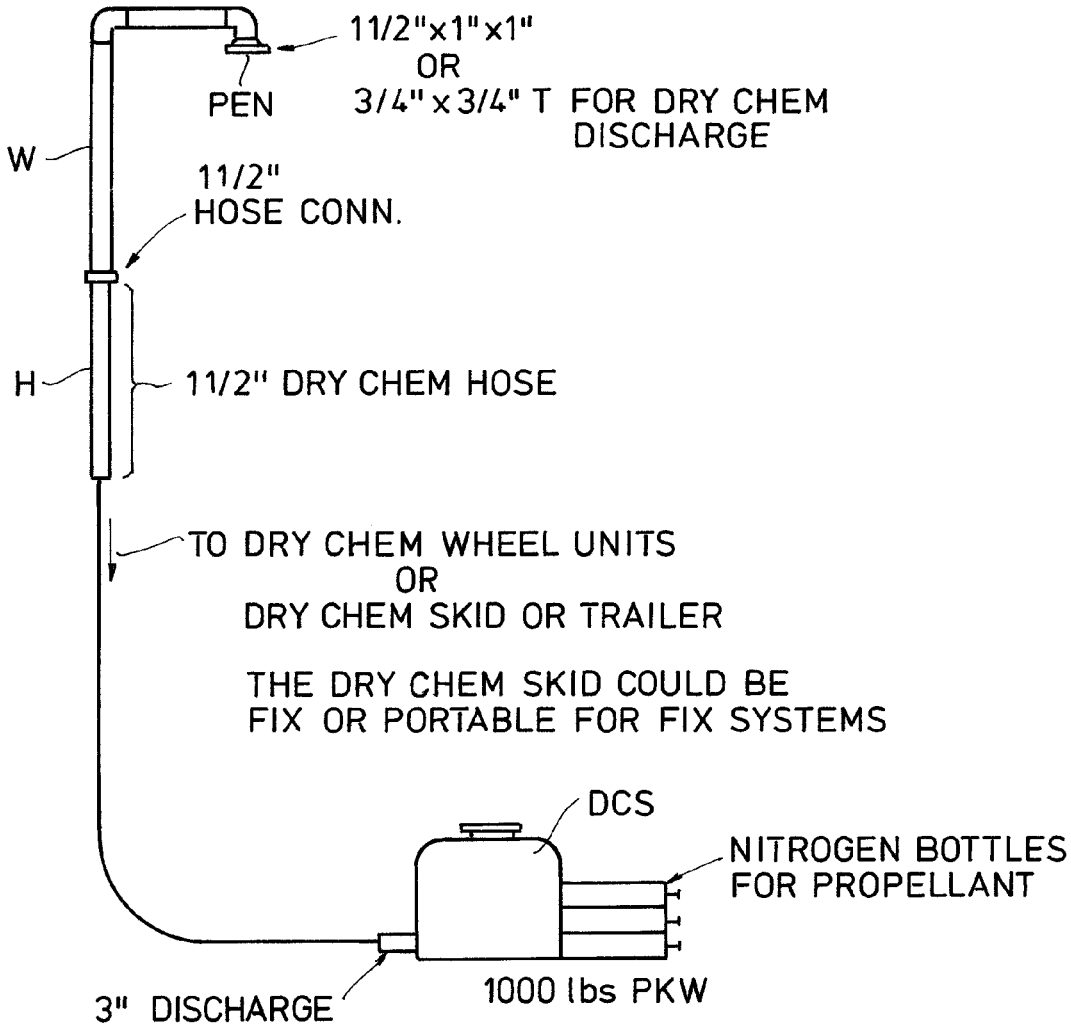
FIG. 8A illustrates a preferred portable dry chemical wand with T'ed nozzle.

FIG. 8A illustrates a wand W which can be used in a portable system for the application of dry chemical in the instant invention. Wand W is preferably comprised of 1½" pipe with appropriate elbows and terminating on the distal end in a dry chemical nozzle PEN. FIG. 8A illustrates a T'ed dry chemical nozzle. However, a cellar-style nozzle could also be used for the dry chemical at the distal end of the wand. Cellar-style nozzles are known in the art. FIG. 8A illustrates wand W connected to hose H, utilizing a 1½" hose connector. Hose H is a 1½" dry chem hose that connects to a source of dry chemical such as skid source DCS. FIG. 8B illustrates a commercially available (ANSUL) skid source of dry chemical DCS. The dry chemical skid could be a fixed dry chemical source or a portable dry chemical source.

Figure 9:
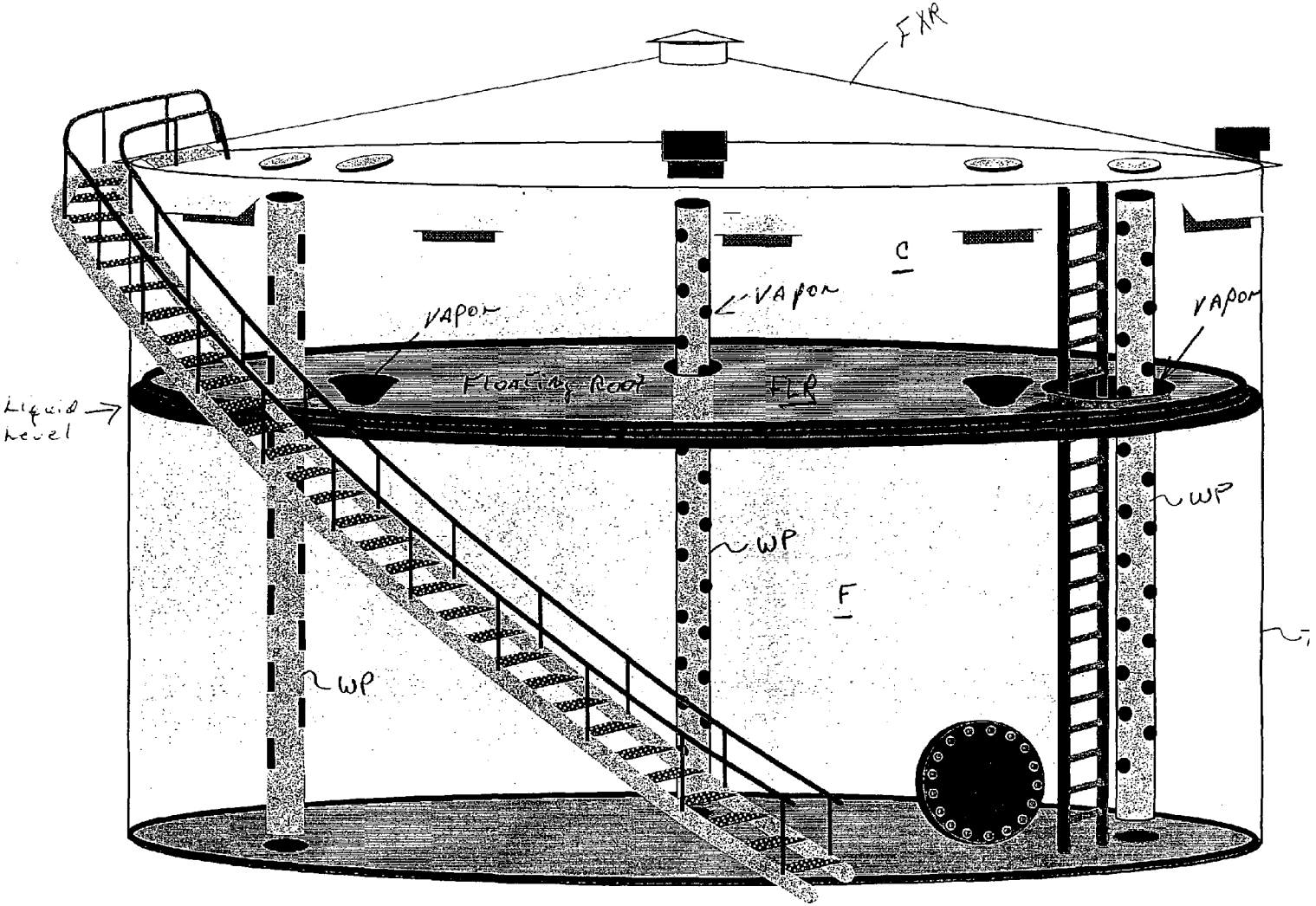
FIG. 9 illustrates in more detail a tank with a fixed and a floating roof and source of vapor in the cavity.

FIG. 9 illustrates in more detail, although not necessarily to scale, tank T having fixed roof FXR and floating roof FLR. Floating roof rides on top of fluid F creating cavity C above the floating roof and below the fixed roof FIG. 9 illustrates various sources of vapor escaping from fluid F into cavity C. The vapor can escape through the typical well pipes WP fixed in the tank. Alternately vapor can escape through ladder connections in the tank. Even though a foam blanket may cover floating roof FLR, FIG. 9 illustrates that there remains means for vapor to collect in cavity C from fluid F below floating roof FLR.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below. Since the foregoing disclosure and description of the invention are illustrative and explanatory thereof, various changes in the size, shape, and materials, as well as in the details of the illustrated device may be made without departing from the spirit of the invention. The invention is claimed using terminology that depends upon a historic presumption that recitation of a single element covers one or more, and recitation of two elements covers two or more, and the like. Also, the drawings and illustration herein have not necessarily been produced to scale.

What is claimed is:

1. A method for treating a liquid fire associated with an industrial tank having a roof and a substantially enclosed space above liquid in the tank and below the roof, and wherein the liquid consists essentially of fuels or flammable liquids, comprising:

establishing a foam/film blanket over at least 90% of a surface of the liquid within the tank; and discharging dry powder into a space between the roof and said blanket, the discharging through a pre-existing opening or vent in structure of the tank or fixed roof, above the blanket.

2. The method of claim 1 wherein the discharging step is subsequent to establishing at least two-thirds of an NFPA recommended foam/film blanket.

3. The method of claim 1 wherein the discharging occurs during a last 10 minutes of an NFPA recommended time of application of foam.

4. The method of claim 1 that includes cooling tank and/or roof wall portions above the liquid level with water fog prior to the discharging.

5. A method for extinguishing a fire of a liquid in an industrial storage tank fitted with at least a significant fixed top roof portion, and wherein the liquid consists essentially of fuels or flammable liquids, comprising:

discharging foam into a cavity above the fuel/flammable liquid and below the fixed top roof portion; and after at least two-thirds of the way through a an NFPA-recommended application rate/duration procedure guideline for the foam attack, discharging dry chemical into a cavity above the fuel/flammable liquid and below the fixed roof portion through a pre-existing opening or vent in structure of the tank or fixed roof above the blanket.

6. The method of claim 5 that includes discharging dry chemical in a last ten minutes of the NFPA recommended application rate/duration procedure guideline.

7. The method of claim 5 that includes discharging dry chemical for 5 to 15 seconds.

8. The method of claim 5 that includes discharging dry chemical after at least 40 minutes of foam application.

9. The method of claims 1 or 5 that includes discharging thy chemical through at least one pre-existing upwind tank vent or opening where flames are manifest in a downwind vent or opening and not at said at least one upwind vent or opening.

10. The method of claims 1 or 5 that include discharging the dry chemical in a direction substantially tangential to an inner tank wall portion proximate the opening or vent.

11. The method of claim 5 wherein an interior roof includes a floater on top of the fuel/liquid and the discharging of foam and of dry chemical includes a discharging into a cavity defined between the floater and the fixed top roof portion.

12. Apparatus comprising;

an industrial storage tank containing a liquid and having a fixed roof portion, defining a space or cavity above the fuel/liquid surface and below the fixed roof portion and wherein the liquid consists essentially of fuels or flammable liquids; and a dry chemical supply pipe system, for extinguishing fire, rising along a portion of a tank wall having at least one end opening into a tank aperture, the pipe system in fluid communication with a source of dry powder and structured to discharge predominantly all dry chemical into the space just left and right of the aperture.

13. The apparatus of claim 12 wherein the supply pipe system includes a wand.

14. The apparatus of claim 13 wherein the wand includes a T'ed discharge nozzle, discharging substantially all dry chemical just left and right.

15. The apparatus of claim 12 that includes a floater, and wherein the space defined above the fuel/liquid surface is space defined above the floater.

16. The method of claim 1 wherein establishing said blanket is prior to significant discharging of dry powder.

17. The method of claim 5 wherein essentially all dry chemical is discharged after at least two-thirds of the way through an NFPA recommended procedure guidelines for the foam attack.

18. The apparatus of claim 12 wherein the pipe system is structured to discharge greater than 80% of the dry chemical into the space just left and just right of the aperture.

* * * * *